US011596215B2

(12) United States Patent
Suyama

(10) Patent No.: US 11,596,215 B2
(45) Date of Patent: Mar. 7, 2023

(54) METHOD AND TOOL FOR PREVENTING SLIDING DOWN OF SHOULDER BELT OF SHOULDER BAG, AND SHOULDER BAG

(71) Applicant: Makoto Suyama, Iruma (JP)

(72) Inventor: Makoto Suyama, Iruma (JP)

( * ) Notice: Subject to any disclaimer, the term of this patent is extended or adjusted under 35 U.S.C. 154(b) by 0 days.

(21) Appl. No.: 16/969,536

(22) PCT Filed: Feb. 14, 2019

(86) PCT No.: PCT/JP2019/005356
§ 371 (c)(1),
(2) Date: Aug. 12, 2020

(87) PCT Pub. No.: WO2019/160042
PCT Pub. Date: Aug. 22, 2019

(65) Prior Publication Data

US 2021/0000236 A1 Jan. 7, 2021

(30) Foreign Application Priority Data

Feb. 14, 2018 (JP) ..... JP2018-023694

(51) Int. Cl.
*A45C 13/30* (2006.01)
*A45C 3/02* (2006.01)
(Continued)

(52) U.S. Cl.
CPC ..... *A45C 13/30* (2013.01); *A45F 3/02* (2013.01); *A45F 3/14* (2013.01); *A45F 3/12* (2013.01); *A45F 2003/142* (2013.01)

(58) Field of Classification Search
CPC ..... A45C 13/30; A45F 3/02; A45F 3/14
(Continued)

(56) References Cited

U.S. PATENT DOCUMENTS 794,948 A * 7/1905 Rischard ..... A45F 3/14 224/257
2,915,233 A * 12/1959 Moomaw ..... F41C 33/002 224/268
(Continued)

FOREIGN PATENT DOCUMENTS

CN 206275294 6/2017
JP 4712341 A * 5/1972 ..... A61K 39/385
(Continued)

OTHER PUBLICATIONS

"Search Report of Europe Counterpart Application", dated Oct. 5, 2021, pp. 1-7.

*Primary Examiner* — Scott T McNurlen
*Assistant Examiner* — Lester L Vanterpool
(74) *Attorney, Agent, or Firm* — JCIPRNET

(57) ABSTRACT

Disclosed are shoulder belt sliding-down preventing method, and a related preventing tool, shoulder belt, and bag. The belt-shaped neck hanging element is connected to a belt at positions separated from each other via connecting members. A loop-shaped space is thereby formed between the belt body and the neck-hanging element. The head passes through this space, and the neck hanging element contacts the side of the neck. In operation, the connecting member is removed and held with one hand, the belt body is hung on the shoulder, the connecting member is passed around the back of the neck, the neck hanging element is hung around the neck, and the connecting member is engaged again with the belt body. The belt body of the shoulder bag can hang on the shoulder and the neck hanging element can be wound around the neck, thereby preventing the belt body from sliding down the shoulder.

4 Claims, 4 Drawing Sheets

(51) Int. Cl.

| | |
|---|---|
| ***A45C 3/14*** | (2006.01) |
| ***A45C 3/12*** | (2006.01) |
| ***A45F 3/02*** | (2006.01) |
| ***A45F 3/14*** | (2006.01) |
| *A45F 3/12* | (2006.01) |

(58) Field of Classification Search
USPC ..... 224/257, 258, 607, 578, 579
See application file for complete search history.

(56) References Cited

U.S. PATENT DOCUMENTS

| | | | | | |
|---|---|---|---|---|---|
| 4,037,633 | A * | 7/1977 | Gordon | A45C 13/26 | 383/14 |
| 4,487,346 | A * | 12/1984 | Fischer, Jr. | A47D 13/025 | 224/259 |
| 4,637,535 | A * | 1/1987 | Aleman | A45F 5/00 | 224/257 |
| 4,844,306 | A * | 7/1989 | Ruff | A61B 5/02233 | 224/258 |
| 4,991,758 | A * | 2/1991 | Eaneff | F16M 13/04 | 224/264 |
| 5,161,486 | A * | 11/1992 | Brown | A01K 27/00 | 119/776 |
| 5,282,558 | A * | 2/1994 | Martinez | F41C 33/002 | 224/602 |
| 5,358,159 | A * | 10/1994 | Lundie, Jr. | F41C 33/046 | 224/640 |
| 5,842,444 | A * | 12/1998 | Perrulli | A01K 27/003 | 119/857 |
| 5,927,574 | A * | 7/1999 | Ruesink | F41C 33/003 | 224/907 |
| 6,168,060 | B1 * | 1/2001 | Mayers | A63B 55/408 | 224/257 |
| 8,302,830 | B1 * | 11/2012 | Jensen | A45F 3/02 | 224/625 |
| 2002/0084296 | A1 * | 7/2002 | Roscoe-Dare | G10G 5/005 | 224/259 |
| 2004/0238584 | A1 * | 12/2004 | Herold | A45F 3/047 | 224/610 |
| 2006/0289587 | A1 * | 12/2006 | Herold | A45F 3/14 | 224/627 |
| 2013/0008934 | A1 * | 1/2013 | Liu | A45F 3/04 | 224/617 |
| 2014/0069977 | A1 * | 3/2014 | Liu | A45F 3/04 | 224/627 |
| 2015/0068651 | A1 * | 3/2015 | Tekulve | A45C 9/00 | 150/103 |
| 2017/0086554 | A1 * | 3/2017 | Felix | A45C 13/08 | |
| 2019/0261754 | A1 * | 8/2019 | Fujikura | A45C 13/30 | |
| 2020/0178679 | A1 * | 6/2020 | Swaggart | A45C 13/30 | |

FOREIGN PATENT DOCUMENTS

| | | | | |
|---|---|---|---|---|
| JP | S47-12341 | | 5/1972 | |
| JP | S47-012341 | | 10/1972 | |
| JP | S5239410 | | 3/1977 | |
| JP | H10-262721 | A | 10/1998 | |
| JP | 11127938 | A * | 5/1999 | A45C 13/30 |
| JP | H11-127938 | A | 5/1999 | |
| JP | 2003-174916 | A | 6/2003 | |
| JP | 2008-023279 | A | 2/2008 | |
| JP | 2008023279 | | 2/2008 | |
| JP | 2011-062516 | A | 3/2011 | |

* cited by examiner

METHOD AND TOOL FOR PREVENTING SLIDING DOWN OF SHOULDER BELT OF SHOULDER BAG, AND SHOULDER BAG

FIELD OF THE INVENTION

The present invention relates to a shoulder belt which hangs on one shoulder to hold containers such as a bag, and a bag comprising the shoulder belt. And more particularly, the present invention relates to a shoulder belt sliding-down preventing method for effectively preventing a shoulder belt from sliding down from the shoulder, a shoulder belt sliding-down preventing tool, a shoulder belt having the a shoulder belt sliding-down preventing method and the shoulder belt sliding-down preventing tool, and a bag.

BACKGROUND OF THE INVENTION

The prior arts that disclose a shoulder belt or a shoulder strap that prevents a shoulder bag and so on from sliding off the shoulder could be found in patent documents 1 to 3.

PRIOR ART DOCUMENTS

Patent Document 1: JP-A-H10-262721
Patent Document 2: JP-A-2003-174916
Patent Document 3: JP-A-2011-62516

SUMMARY OF THE INVENTION

The shoulder belt described in the patent document 1 is a portable shoulder belt that hangs, from a shoulder, a storage body that stores various items or a holding body that holds various items. Two ends of a string is fixed with two points of the shoulder belt, and the two points are separated by a predetermined distance along a length direction of the shoulder belt. A loop is formed by the string and the shoulder belt to allow an arm to pass through, and a portion of the string hangs on the shoulder. A portion of the shoulder belt not forming the loop hangs on the other shoulder.

The shoulder belt described in the patent document 2 composes a belt body for hanging on one shoulder and a loop-shaped auxiliary belt connected to the belt body.

The shoulder bag sliding-down prevention tool described in patent document 3 comprises: a neck mounting portion, which is made of a wire-shaped first core member as a main member, being provided with a curved portion along a neck of a body; and a belt hooking portion, which is made of a wire-shaped second core member as a main member, having one end thereof rotatably connected to one end of the neck mount portion, and being provided with a folded portion curved from an intermediate curved portion to the other end thereof so as to hang a shoulder belt thereon.

In the patent documents 1 and 2, since the cord is hung on the shoulder, it is troublesome to change the hanging position of the shoulder belt from one shoulder to the other shoulder.

Since the tool disclosed in patent document 3 is formed by the neck mounting portion consisting of a U-shaped curved portion along the neck, it is troublesome to change the hanging position of the shoulder belt from one shoulder to the other shoulder based on the reason that opening portion of the neck mounting portion should be facing the front side of the body to alter the neck mounting portion.

Furthermore, since the tool disclosed in patent document 3 is formed by having the shoulder belt (shoulder hanging belt) separated away, it is troublesome that the shoulder bag and the sliding-down prevention tool must be stored separately, and both of them should be prepared at the time of wearing.

An objective of the present invention is to provide a shoulder belt sliding-down preventing method, a sliding-down preventing tool, a shoulder belt, and a bag with merits that it is easy to change the hanging position of the shoulder belt between the two shoulders while a shoulder-belt sliding-down preventing function is provided.

The shoulder belt sliding-down preventing method of the present invention comprises forming a ring-shape space between a belt body and a neck hanging element, the ring-shape space being formed by connecting the neck hanging element to separate positions of the belt body which hangs on one shoulder, wherein the neck hanging element of the ring-shape space hangs around and contacts a neck's lateral side on the other shoulder while a portion of the belt body of the ring-shape space hangs on the neck, thereby preventing the belt body from sliding down from shoulder.

In the present invention, the shoulder belt is capable of being hung on one shoulder to hold a storage body such as a bag. The present invention has a belt body made of the same material as the storage body, or has a belt body made of a material different from the storage body to fix to the front and back sides of the storage body via a connecting member. According to the present invention, both side portions of the belt-shaped neck hanging element are connected to respective separate positions of the belt body via the connecting members. By connecting the belt-shaped neck hanging element, a loop-shaped space is formed between the belt body and the neck hanging element. Put the head through the space and hang the neck hanging element around the neck and contacts a neck's lateral side. When the connecting member is formed removable, one connecting member is able to be removed, the removed portion is then held with one hand, and then hang the belt body on the shoulder and pass the holding connecting member through the back side of the neck, and winding the neck hanging element around the neck, and then engage the removed connecting member with the belt body again. As a result, the belt body of the shoulder bag is able to be hung on the shoulder, and the neck hanging portion can be wound around the neck such that the neck hanging portion become effectively preventing the belt body from sliding down the shoulder.

Since most of the load of the bag is downward due to the gravity, about 90% of the load of the bag is hung on the shoulder via the shoulder belt body, and about only 10% of the load is hung on the neck hanging part, and therefore the load of the neck hanging portion on the neck is very small.

Moreover, changing the hanging position of the belt body from one shoulder to another can be completed simply by rotating the belt body about the loop-shaped space formed between the belt body and the neck hanging element.

Furthermore, the present invention could use necklace made of various materials such as pearls, metals, natural stones, etc., as the neck hanging element and could form the neck hanging element with a metal chain such as leather or ball type chain, Kihei chain, Azuki chain, Venetian chain, etc., when the neck hanging element is attached to the belt body, the appearance (outer shape) of the present invention becomes excellent in fashionability and can be used for high-grade bags and the like. Furthermore, if the width of the belt body is wide and large, it is difficult to hook the belt body on a hook or the like having a small protrusion amount, but the neck hanging element of the present invention is thin enough so it could to be easily attached to an ordinary hook or the like for storage.

The shoulder belt sliding-down preventing tool of present invention forms a ring-shape space between a belt body and a neck hanging element, the ring-shape space being formed by connecting the neck hanging element to separate positions of the belt body which hangs on one shoulder, and enables a portion of the belt body, which forms the ring-shape space, to hang on the shoulder, wherein the neck hanging element, which forms the ring-shape space, hangs around and contacts a neck's lateral side on the other shoulder.

This above shoulder belt sliding-down preventing tool corresponds to the shoulder belt sliding-down preventing method.

The shoulder belt of the present invention comprising a belt body which is capable of being hung on left side or right side of shoulders.

The shoulder belt of the present invention comprises the shoulder belt sliding-down preventing tool.

The bag of the present invention comprising the shoulder belt sliding-down preventing tool.

The bag of the present invention comprises the shoulder belt sliding-down preventing tool.

In the present invention, the shoulder belt sliding-down preventing method, the sliding-down preventing tool, the shoulder belt and the bag of the present invention is not only with merit of preventing sliding down from shoulder, but also with merit of easily changing the hanging operation for the shoulder belt.

BRIEF DESCRIPTION OF THE DRAWINGS

FIG. 2 are drawing illustrating a human body wearing the shoulder bag 1 of FIG. 1, wherein FIG. 2A is a left-side view thereof and FIG. 2B is a front view thereof.

DETAILED DESCRIPTION OF THE PREFERRED EMBODIMENTS

Figure 1:
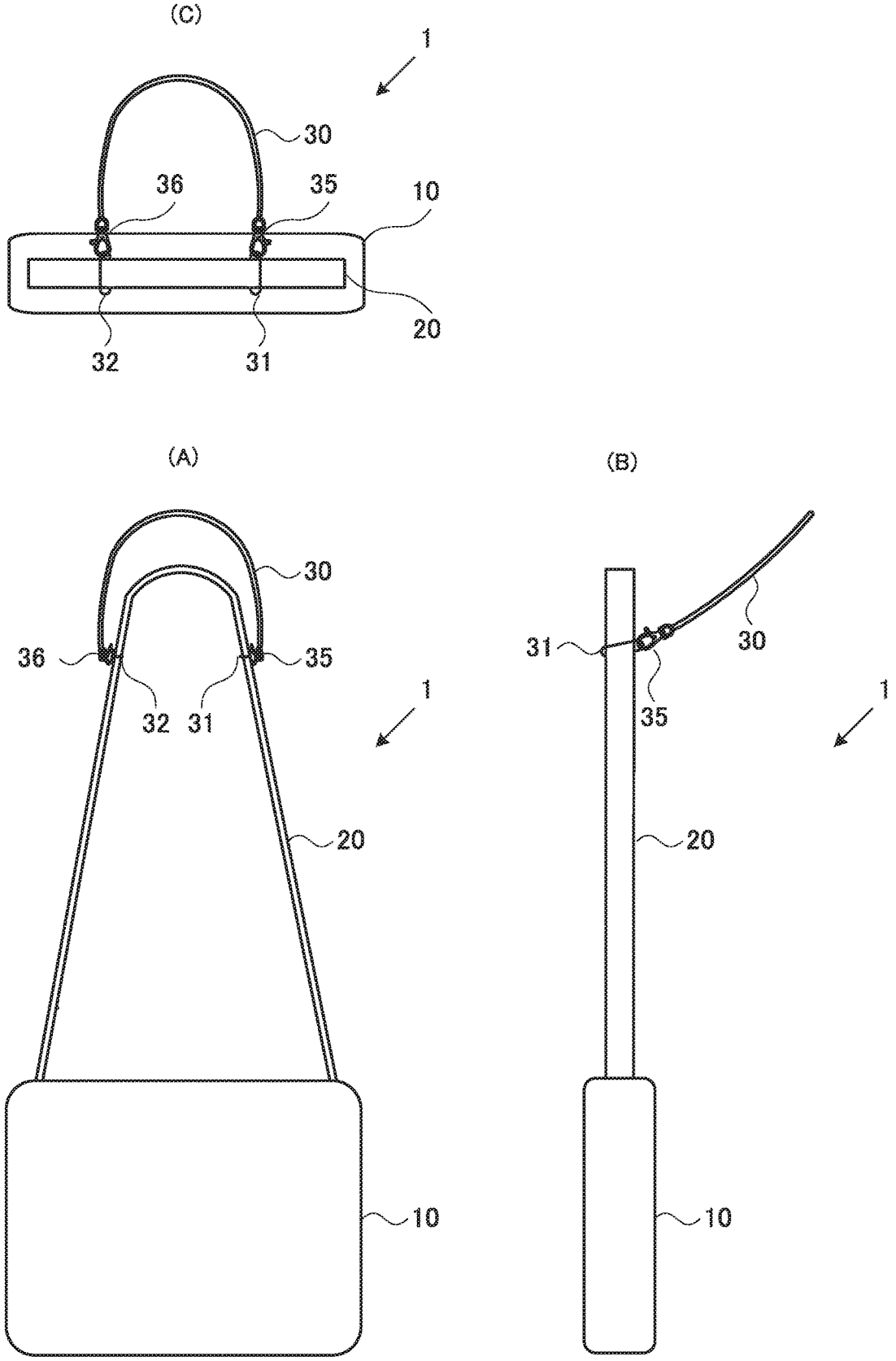
FIG. 1 is a drawing illustrating an example of a bag, i.e. the shoulder bag 1, comprising a shoulder belt sliding-down preventing tool according to the present invention.

Preferred embodiments of the shoulder belt sliding-down preventing method, a sliding-down preventing tool, a shoulder belt and a bag according to the present invention are described below with reference to the accompanying drawings. FIG. 1 is a drawing illustrating an example of a bag, i.e., a shoulder bag 1, comprising a shoulder belt sliding-down preventing tool according to the present invention. FIG. 1(A) is a front-side view of the shoulder bag 1, FIG. 1(B) is a right-side view of FIG. 1A, and FIG. 1(C) is a top view of FIG. 1(A).

The shoulder bag 1 comprises a storage portion 10 for storing items, and a shoulder belt portion 20 which is for hanging on a shoulder and is fixed on both ends of the storage portion 10. The shoulder bag 1 may be provided at a front surface thereof with an outer pocket. The shoulder belt portion 20 may be engaged with the storage portion 10 in a removable manner or a non-removable manner. The shoulder belt portion 20 may be made of a material the same as or different from that of the storage portion 10. Furthermore, the shoulder belt portion 20 may include a shoulder pad.

In this embodiment, a neck-hanging belt portion 30, which is hung around the neck portion like a necklace, is connected to and fixed to respective separate positions of the shoulder belt portion 20. The neck-hanging belt portion 30 could be made of a material of leather same as the material used in a wallet cord or a wallet chain or could be made of a metal chain. FIG. 1 illustrates the neck-hanging belt portion 30 which is made of leather or a cord formed by braiding the leather. The neck-hanging belt portion 30 may be made of an ornament, such as a necklace made of various materials such as ordinary pearls, metals and natural stones. Furthermore, the neck-hanging belt portion 30 may be formed of a metal chain, such as a ball type chain, a Kihei chain, an Adzuki chain, or a Venetian chain.

Engaging portions 31 and 32 formed of square buckles are attached to the shoulder belt portion 20. Both ends of the neck-hanging belt portion 30 are detachably connected to the two engaging parts 31 and 32, respectively. In this embodiment, connecting members 35 and 36, such as swivel eye snap hook or snap hook, provided on both ends of the neck-hanging belt portion 30 are hooked on the engaging portions 31 and 32. The connecting members 35 and 36 are formed of a metal ring, and may be other than swivel eye snap hook or snap hook, as long as a part of the ring can be opened and closed and has a push-to-fasten function.

Furthermore, the connecting members 35 and 36 may be directly attachable to the shoulder belt portion 20. Alternatively, when the shoulder belt portion 20 is provided on itself with something like the engaging portions 31 and 32, the connecting members 35 and 36 may be engaged with the engaging portion that is a part of the shoulder belt portion 20. Preferably, the engaging portions 31 and 32 may be freely movable along a length direction of the shoulder belt portion 20. Alternatively, one or both of the engaging portions 31 and 32 may be fixedly attached to the shoulder belt portion 20. Furthermore, in the case that the shoulder pad is attached to the shoulder belt portion 20, the shoulder pad may be provided with an engaging portion.

It is preferable that the total length of the neck-hanging belt portion 30 including the connecting members 35 and 36 is about 35 to 53 cm. This length is provided respectively corresponding to the length of a necklace choker: 35-40 cm, a princess: 40-45 cm, and a matinee: 50-53 cm. The choker length is suitable for a petite person, the princess length is suitable for a normal size person, and the matinee length is suitable for a big and tall person. Note that the length may be appropriately adjustable depending on the physique. For example, a length adjusting ring or the like may be inserted between the neck-hanging belt portion 30 and the connecting members 35 and 36, and be inserted between the connecting members 35 and 36 and the engaging portions 31 and 32, respectively. Alternatively, a length adjusting ring or the like may be inserted between the neck-hanging belt portion 30 and the connecting members 35 and 36, or may be inserted between the connecting members 35 and 36 and the engaging portions 31 and 32. In the case that the neck-hanging belt portion 30 is formed of a metal chain or the like, the length of the neck-hanging belt portion 30 may be appropriately changed by adjusting the positions where the connecting members 35 and 36 are attached to the metal chain.

Figure 2:
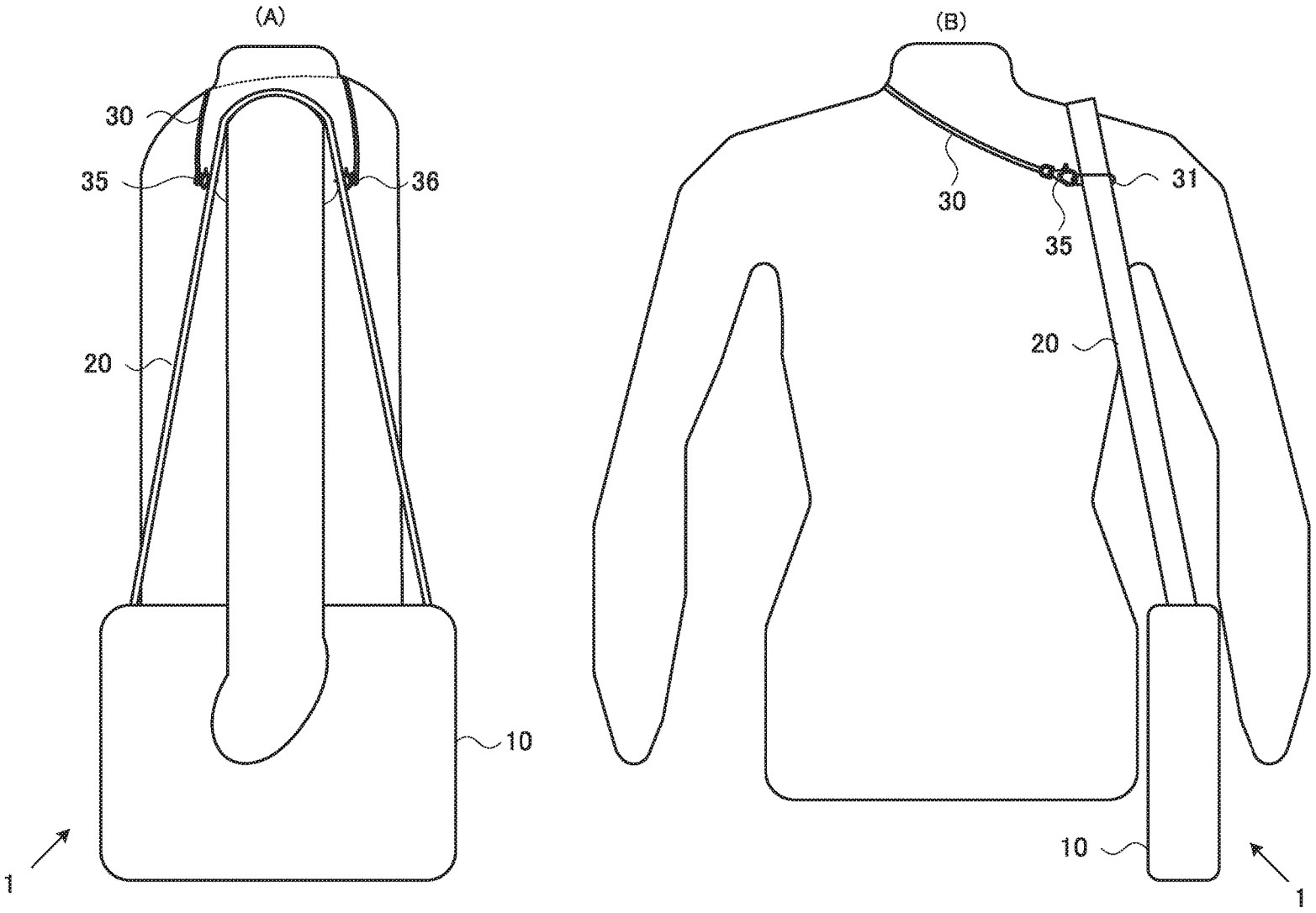

FIG. 2 is a drawing illustrating a human body wearing the shoulder bag 1 of FIG. 1. FIG. 2(A) is a left-side view thereof, and FIG. 2B is a front view thereof. In FIG. 2, only the upper half of the human body is shown. Before hang the shoulder belt portion 20 on the left shoulder, detach the connecting member 35 of the neck belt portion 30 from the engaging portion 31 of the shoulder belt portion 20, and hold the connecting member 35 by the right hand. Then, hang the shoulder belt portion 20 on the left shoulder and pass the connecting member 35 held in the right hand through the back side of the neck to wind the neck-hanging belt portion 30 around the neck, and put the connecting member 35 to engage with the engaging portion 31 of the shoulder belt portion 20. Accordingly, as shown in FIG. 2, the shoulder bag 1 can be hung on the shoulder, and the neck-hanging belt portion 30 can be wound around the neck. In addition, as shown in FIG. 1(C), it also can be worn by passing the head through the ring (circular space portion) formed by the shoulder belt portion 20 and the neck-hanging belt portion 30. And then hang the shoulder belt portion 20 on the left shoulder without detaching the connecting member 35 from the engaging portion 31.

By directly using a necklace made of various materials such as ordinary pearls, metals and natural stones as the neck-hanging belt portion 30, the neck-hanging belt portion 30 itself becomes an ornament as shown in FIG. 2(B), of which the appearance from the front is dramatically improved, making it fashionable.

Figure 3:
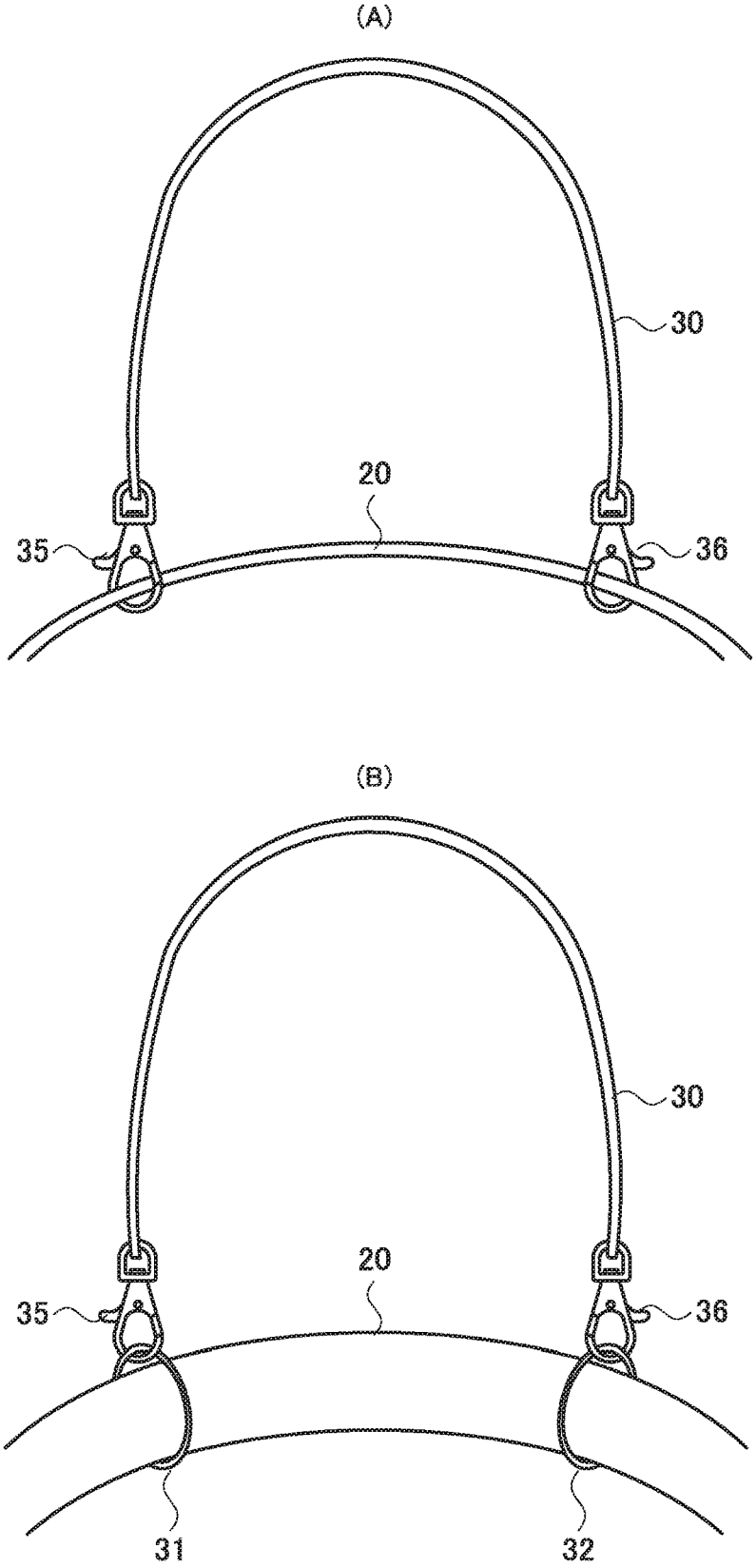
FIG. 3 is a drawing illustrating a first variant of the embodiment of the present invention.

FIG. 3 is a drawing illustrating a first variant of the embodiment of the present invention. FIG. 3(A) shows that the connecting members 35 and 36 are directly engaged with the shoulder belt portion 20 when the shoulder belt portion 20 has a small diameter and is thin, and accordingly the engaging portions 31 and 32 are unnecessary. The configuration of FIG. 3A can be realized by appropriately adjusting the diameter of the shoulder belt portion 20 and the inner diameters of the connecting members 35 and 36.

FIG. 3(B) shows a case that the connecting members 35 as shown in FIG. 3(A), which has a small inner diameter and cannot be engaged directly to the shoulder belt portion 20, becomes able to engage with the shoulder belt portion 20 by providing the engaging portions 31 and 32 on the shoulder belt portion 20. That is, the configuration is the same as that shown in FIG. 1 and FIG. 2.

Figure 4:
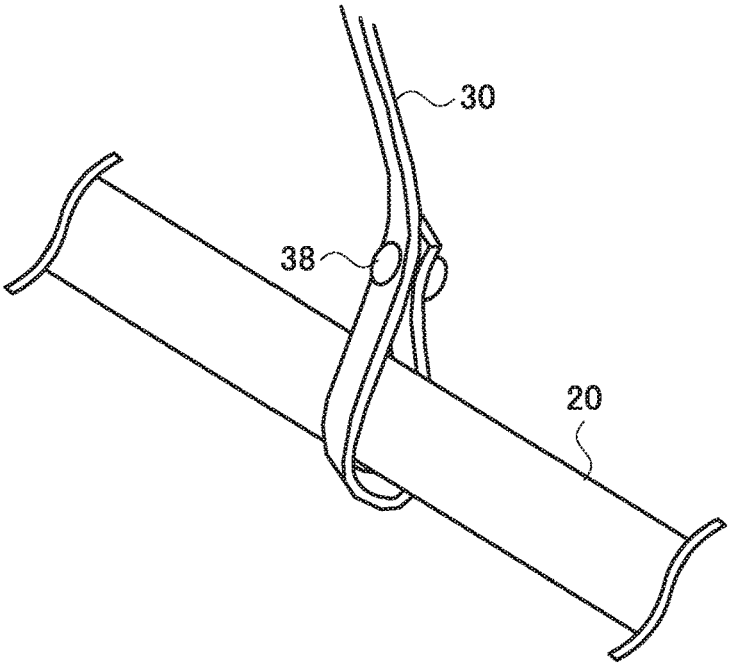
FIG. 4 is a drawing illustrating a second variant of the embodiment of the present invention.
Figure 4:
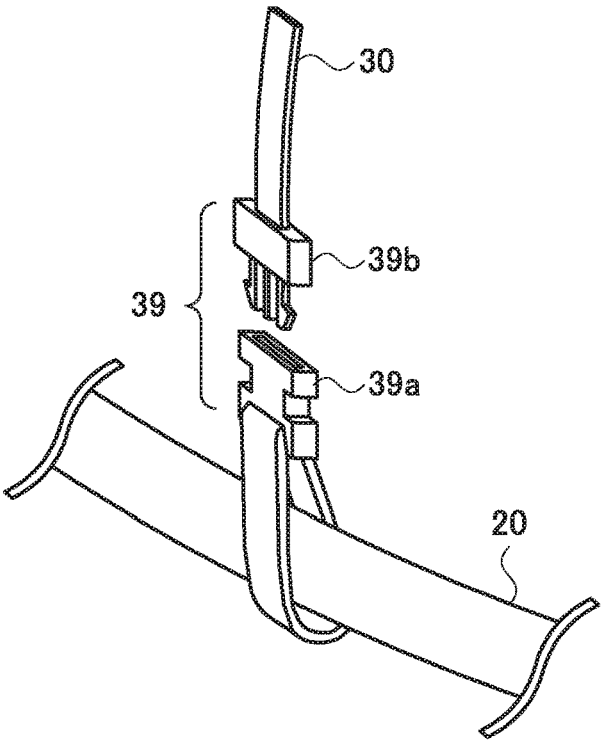

FIG. 4 is a drawing illustrating a second variant of the embodiment of present invention. FIG. 4(A) shows a case of connecting the neck-hanging belt portion 30 to the shoulder belt portion 20, wherein the end portion of the neck-hanging belt portion 30 is fixed by a fixing button 38, to form a ring portion at the end portion, and the shoulder belt portion 20 is passed through the ring portion. The ring portion can slide along the shoulder belt portion 20. By using a detachable button as the fixing button 38, the neck-hanging belt portion 30 can be detached from the shoulder belt portion 20.

FIG. 4(B) shows a case of connecting the neck-hanging belt portion 30 to the shoulder belt portion 20, wherein as the engaging portion, a female element 39*a* of a plastic buckle 39 is utilized to attach to the shoulder belt portion 20. And, as the connecting member, a male portion 39*b* of the plastic buckle 39 is utilized to attach to the neck-hanging belt portion 30. An easily detachable function is thus realized by the plastic buckle 39.

Although the embodiments mentioned above have described the case that the swivel eye snap hook or snap hook is used as the connecting members 35 and 36, an oval swivel eye snap hook, a ring swivel eye snap hook, a round carabiner, a carabiner, or the like may be used as the connecting members 35 and 36 and/or the engaging portions 31 and 32.

A separate part (separation mechanism) or a safety part may provided in the vicinity of the center or near the end of the neck-hanging belt portion 30, and is separable into two parts to detach from the neck-hanging belt portion 30 when pulled away by an excessive force.

1 Shoulder bag
10 Storage portion
20 Shoulder belt portion
30 Neck-hanging belt portion
31, 32 Engaging portion
35, 36 Connecting member
38 Fixing button
39 Plastic buckle

What is claimed is:

1. A shoulder belt slide-down preventing method of a shoulder bag, comprising:

forming a ring-shape space between a belt body and a necklace element, the necklace element being in a total length of 35~53 cm and comprising a metal chain, a cord formed by braiding a leather material or an ornament necklace made of materials selected from the group consisting of pearls, metals, natural stones and mixtures thereof, the ring-shape space being formed by connecting the necklace element to respective separate positions of the belt body of the shoulder bag, and the belt body being configured to hang on one shoulder that is at a bag side, wherein the necklace element of the ring-shape space is configured to hang around and contact a surface of a lateral side of the neck on the other shoulder while a portion of the belt body of the ring-shape space hangs on the one shoulder, thereby preventing the belt body from sliding down from the shoulder, wherein both ends of the necklace element are connected in a freely movable manner along a length direction of the belt body and are detachable from the belt body.

2. A shoulder belt slide-down preventing tool of a shoulder bag, configured to:

form a ring-shape space between a belt body and a necklace element, the necklace element being in a total length of 35~53 cm and comprising a metal chain, a cord formed by braiding a leather material or an ornament necklace made of materials selected from the group consisting of pearls, metals, natural stones and mixtures thereof, the ring-shape space being formed by connecting the necklace element to respective separate positions of the belt body of the shoulder bag, and the belt body being configured to hang on one shoulder that is at a bag side, and enable a portion of the belt body, which forms the ring-shape space, to hang on the one shoulder, wherein the necklace element, which forms the ring-shape space, is configured to hang around and contact a surface of a lateral side of the neck on the other shoulder, and both ends of the necklace element are connected in a freely movable manner along a length direction of the belt body and are detachable from the belt body.

3. A shoulder bag comprising the shoulder belt slide-down preventing tool as claimed in claim 2.

4. A shoulder bag configured to enable the shoulder belt slide-down preventing method as claimed in claim 1 to be performed.

* * * * *